US011814791B2

(12) United States Patent
Aruga et al.

(10) Patent No.: US 11,814,791 B2
(45) Date of Patent: Nov. 14, 2023

(54) SHEET MANUFACTURING APPARATUS

(71) Applicant: SEIKO EPSON CORPORATION, Tokyo (JP)

(72) Inventors: Naoto Aruga, Nagano (JP); Makoto Kawamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 17/485,598

(22) Filed: Sep. 27, 2021

(65) Prior Publication Data

US 2022/0098792 A1 Mar. 31, 2022

(30) Foreign Application Priority Data

Sep. 29, 2020 (JP) ..... 2020-163851

(51) Int. Cl.

| | |
|---|---|
| ***D21F 3/00*** | (2006.01) |
| ***D21F 9/02*** | (2006.01) |
| ***D21G 9/00*** | (2006.01) |
| ***D21F 7/00*** | (2006.01) |

(52) U.S. Cl.

CPC ..... *D21F 3/00* (2013.01); *D21F 7/006* (2013.01); *D21F 9/02* (2013.01); *D21G 9/0009* (2013.01)

(58) Field of Classification Search

CPC ..... D21F 3/00; D21F 9/00; D21F 9/02; D21F 11/00; D21F 11/02; D21F 13/00; D21F 13/08; D21F 7/006; D21F 7/04; D21G 9/0009; D21G 9/0063; D21G 9/0045; D21G 9/0027

See application file for complete search history.

(56) References Cited

U.S. PATENT DOCUMENTS

| | | | | |
|---|---|---|---|---|
| 2014/0027075 | A1 | 1/2014 | Yamagami et al. | |
| 2019/0264393 | A1 | 8/2019 | Taniguchi et al. | |
| 2019/0270220 | A1* | 9/2019 | Oguchi | D21G 9/0063 |
| 2020/0131705 | A1* | 4/2020 | Higuchi | D04H 1/736 |
| 2020/0140217 | A1 | 5/2020 | Fukasawa et al. | |

FOREIGN PATENT DOCUMENTS

| | | | |
|---|---|---|---|
| CN | 101274507 | A | 10/2008 |
| CN | 110202904 | A | 9/2019 |
| EP | 3508632 | A1 | 7/2019 |
| JP | 2012-144819 | A | 8/2012 |

* cited by examiner

*Primary Examiner* — Eric Hug

(74) *Attorney, Agent, or Firm* — Global IP Counselors, LLP

(57) ABSTRACT

A sheet manufacturing apparatus includes a pressing unit, a separate sheet shaping unit, a transportation unit, and a cutting-off unit. The pressing unit includes a pressing roller that presses a material containing fibers and a binder, which has a function of bonding the fibers together, to form the material into a shape of a continuous sheet. The separate sheet shaping unit cuts the continuous sheet into a shape of a separate sheet. The transportation unit is provided between the pressing roller and the separate sheet shaping unit and transports the continuous sheet formed by the pressing unit to the separate sheet shaping unit. The cutting-off unit is provided between the pressing roller and the transportation unit. When transportation abnormality occurs on the continuous sheet that is being transported, the cutting-off unit cuts off, from the continuous sheet, a part of the continuous sheet where the transportation abnormality occurs.

8 Claims, 6 Drawing Sheets

SHEET MANUFACTURING APPARATUS

The present application is based on, and claims priority from JP Application Serial Number 2020-163851, filed Sep. 29, 2020, the disclosure of which is hereby incorporated by reference herein in its entirety.

BACKGROUND

1. Technical Field

Embodiments of the present disclosure relate to a sheet manufacturing apparatus.

2. Related Art

A so-called wet method, which includes processes of putting a raw material that contains fibers into water, defibrating the inputted raw material mainly by means of a mechanical action, and forming the defibrated raw material into reproduced paper, has been used in the field of sheet manufacturing apparatuses. Such a sheet manufacturing apparatus requires a huge amount of water. Therefore, the size of the apparatus is large. Moreover, a lot of labor is needed for maintenance of water processing facilities, and energy needed in a drying process is large.

For the purpose of achieving a reduction in size and saving energy, dry-type sheet manufacturing apparatuses using as little water as possible have been proposed. For example, JP-A-2012-144819 discloses a sheet manufacturing apparatus that forms a web by dry-mixing a defibrated material, which is obtained by defibrating paper by dry defibration without using water, with a binder for bonding fibers in the defibrated material together, then, applying heat and pressure to the web by means of rollers while transporting the web, and, after the heating and pressing, performing cutting to manufacture a sheet having a predetermined size by means of a cutter.

However, in the sheet manufacturing apparatus disclosed in JP-A-2012-144819, the workpiece in process is in a form of a single continuous long sheet until it is cut into a separate sheet size by the cutter after having been formed into such an in-process sheet shape by the rollers. For this reason, if transportation abnormality such as jamming occurs, it is difficult to troubleshoot and clear the transportation abnormality.

SUMMARY

Some aspects of the present disclosure can be implemented as follows.

A sheet manufacturing apparatus according to a certain aspect of the present disclosure has the following features. The sheet manufacturing apparatus includes a pressing unit, a separate sheet shaping unit, a transportation unit, and a cutting-off unit. The pressing unit includes a pressing roller that presses a material containing fibers and a binder, which has a function of bonding the fibers together, to form the material into a shape of a continuous sheet. The separate sheet shaping unit cuts the continuous sheet into a shape of a separate sheet. The transportation unit is provided between the pressing roller and the separate sheet shaping unit and transports the continuous sheet formed by the pressing unit to the separate sheet shaping unit. The cutting-off unit is provided between the pressing roller and the transportation unit. When transportation abnormality occurs on the continuous sheet that is being transported, the cutting-off unit cuts off, from the continuous sheet, a part of the continuous sheet where the transportation abnormality occurs.

DESCRIPTION OF EXEMPLARY EMBODIMENTS

Based on a certain non-limiting advantageous embodiment illustrated in the accompanying drawings, a sheet manufacturing apparatus according to the present disclosure will now be explained in detail.

Embodiment

Figure 1:
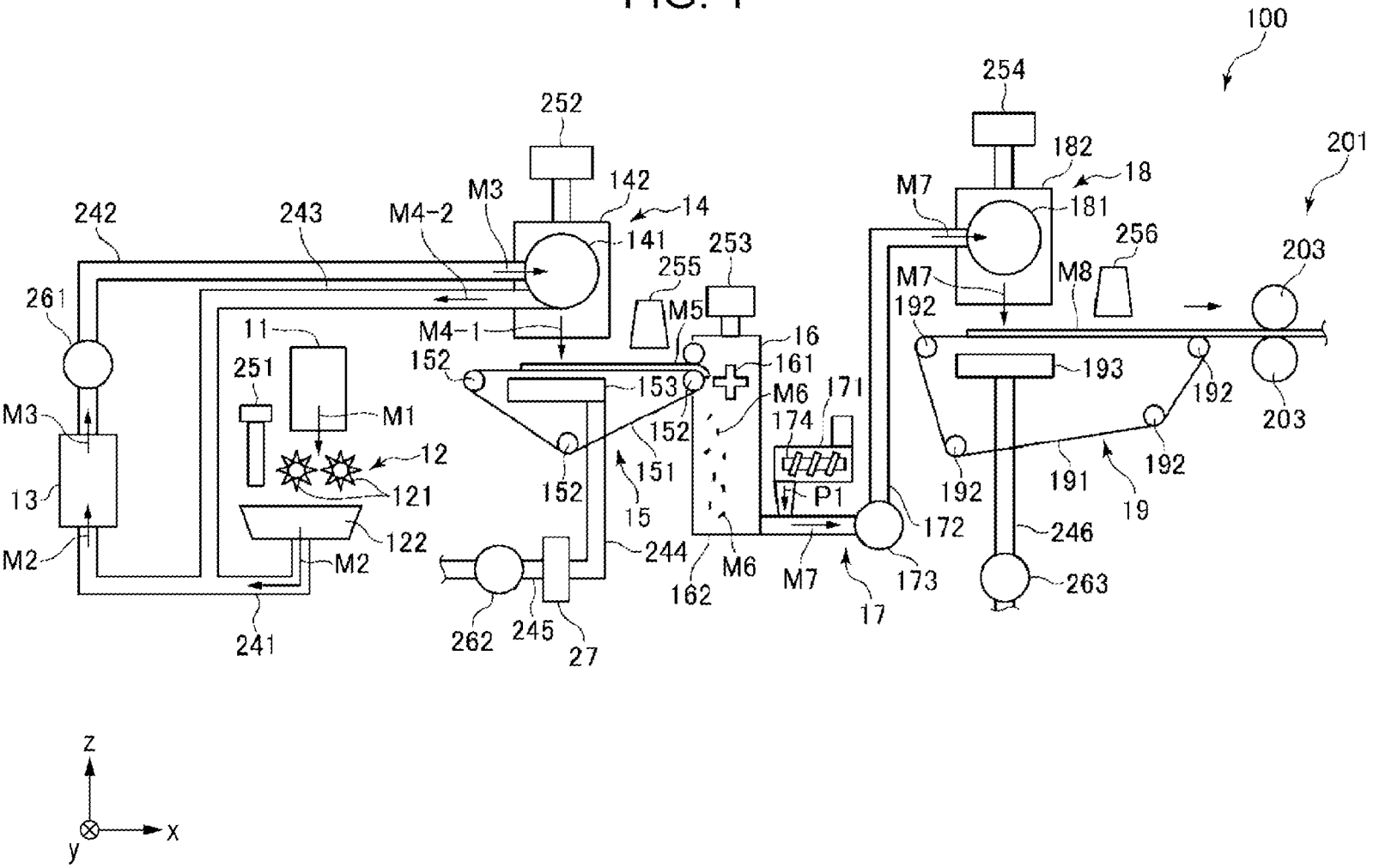
FIG. 1 is a schematic side view of the upstream half of a sheet manufacturing apparatus according to an embodiment of the present disclosure.
Figure 2:
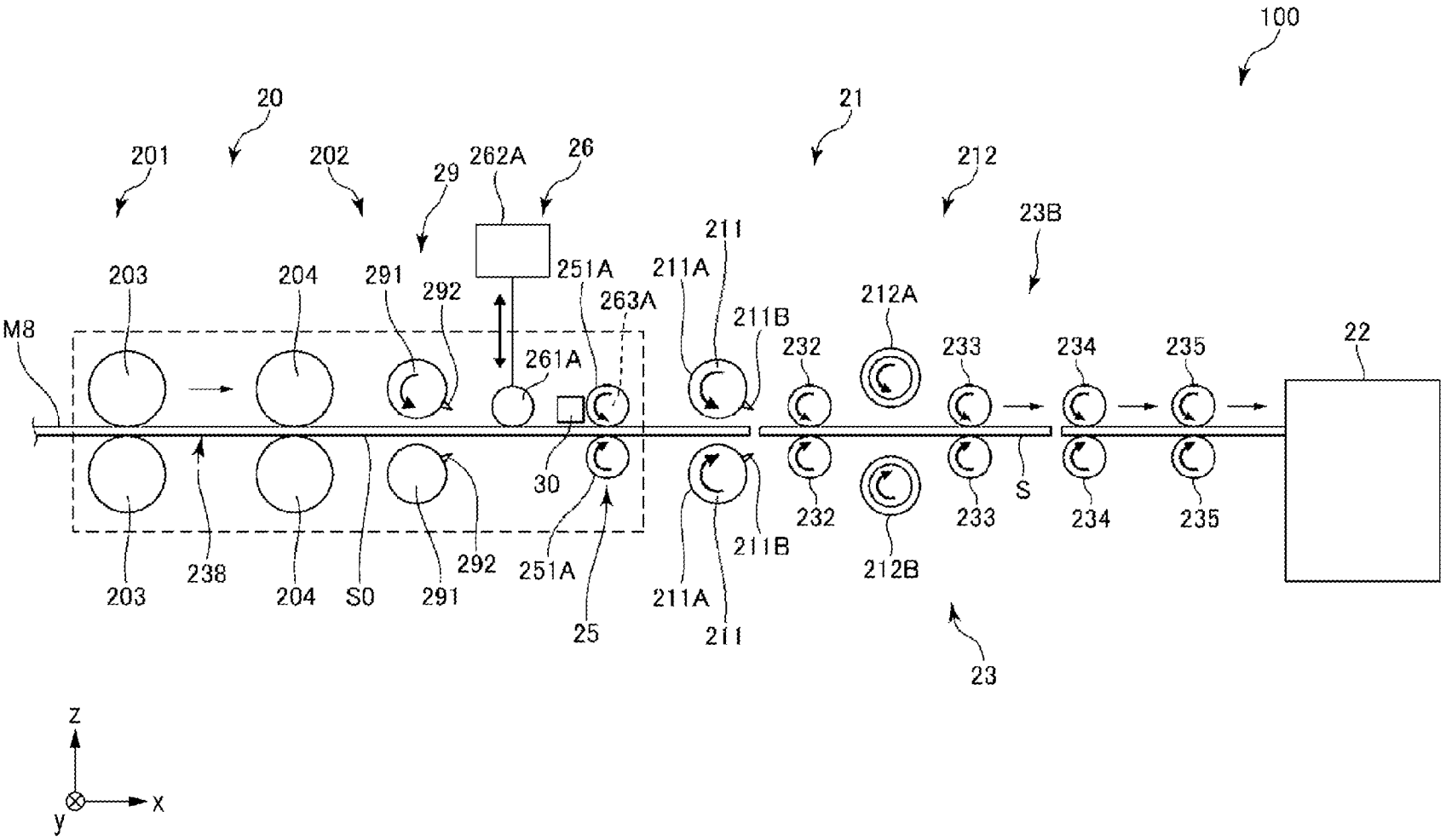
FIG. 2 is a schematic side view of the downstream half of a sheet manufacturing apparatus according to an embodiment of the present disclosure.
Figure 3:
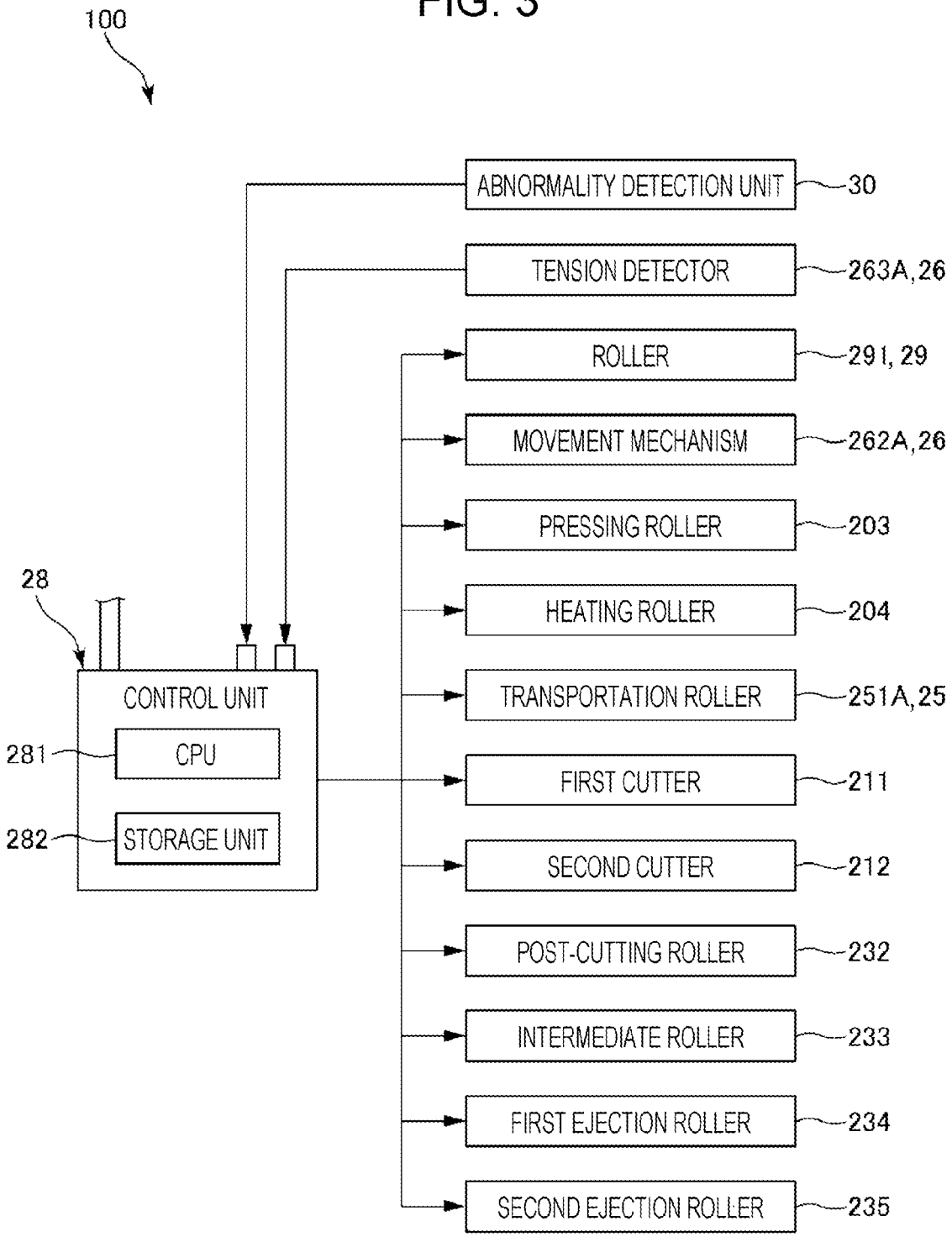
FIG. 3 is a block diagram of major components of the sheet manufacturing apparatus illustrated in FIGS. 1 and 2.
Figure 6:
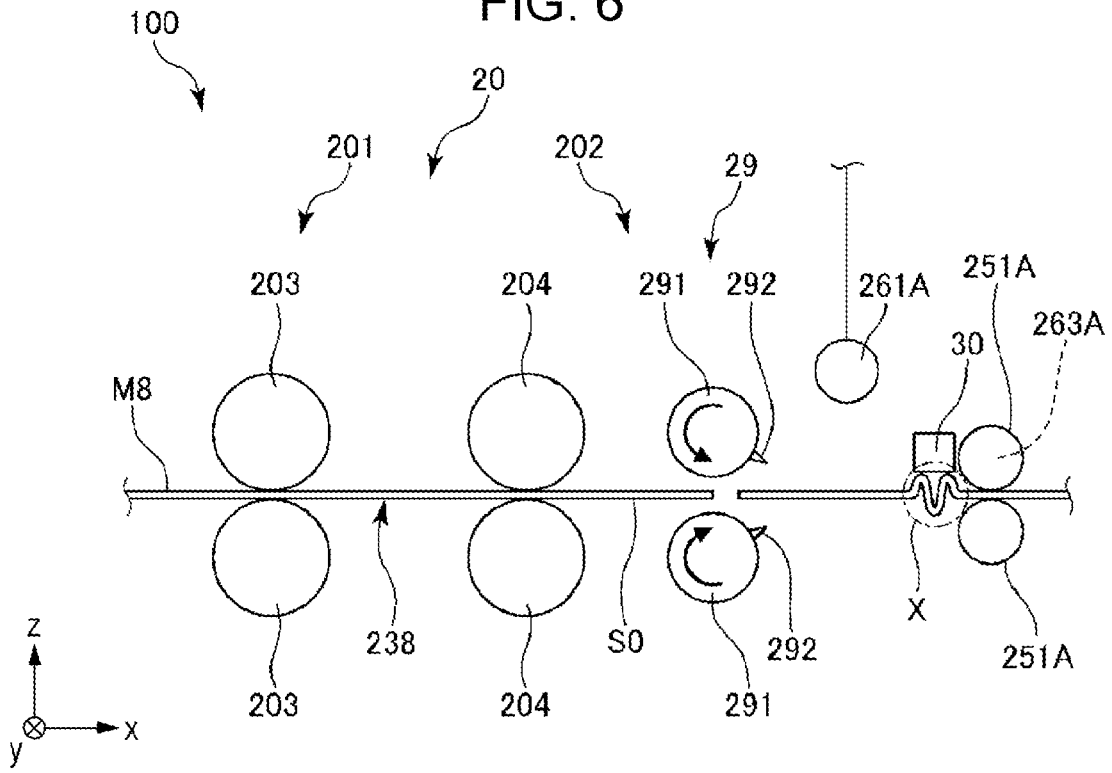
FIG. 6 is an enlarged view, for explaining operation performed when transportation abnormality occurs, of the section enclosed by the broken-line frame illustrated in FIG. 2.
Figure 7:
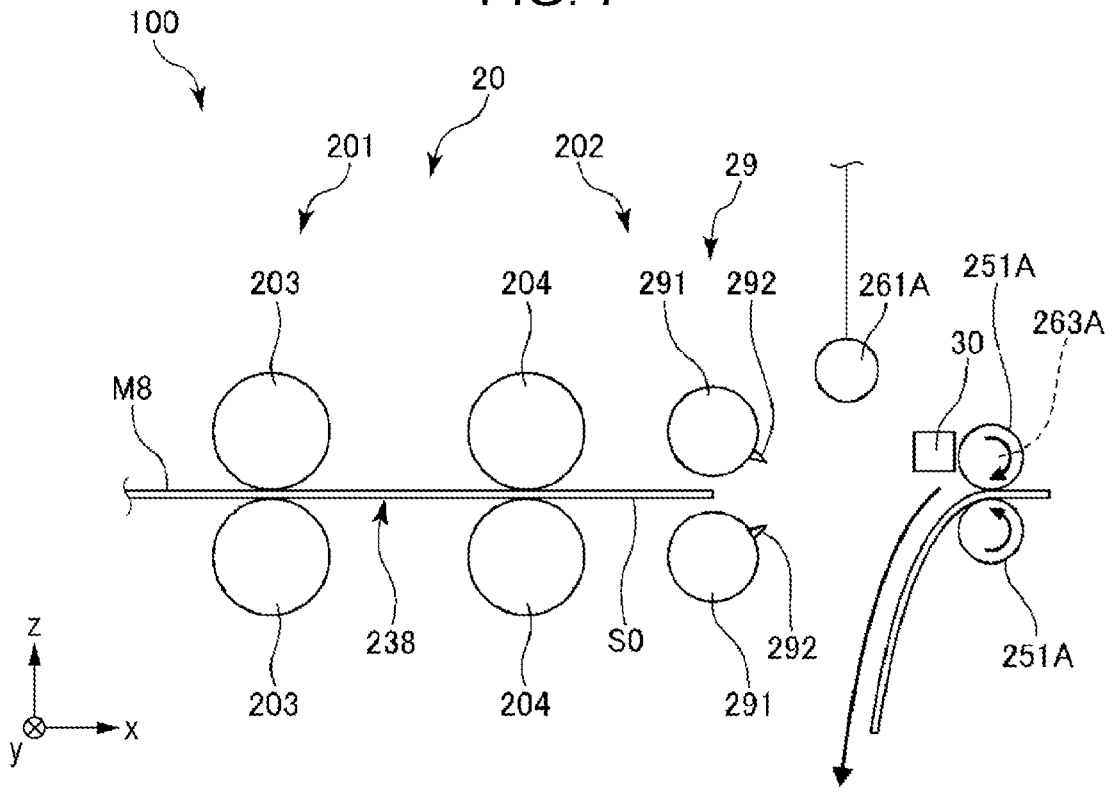
FIG. 7 is an enlarged view, for explaining operation performed when transportation abnormality occurs, of the section enclosed by the broken-line frame illustrated in FIG. 2.
Figure 8:
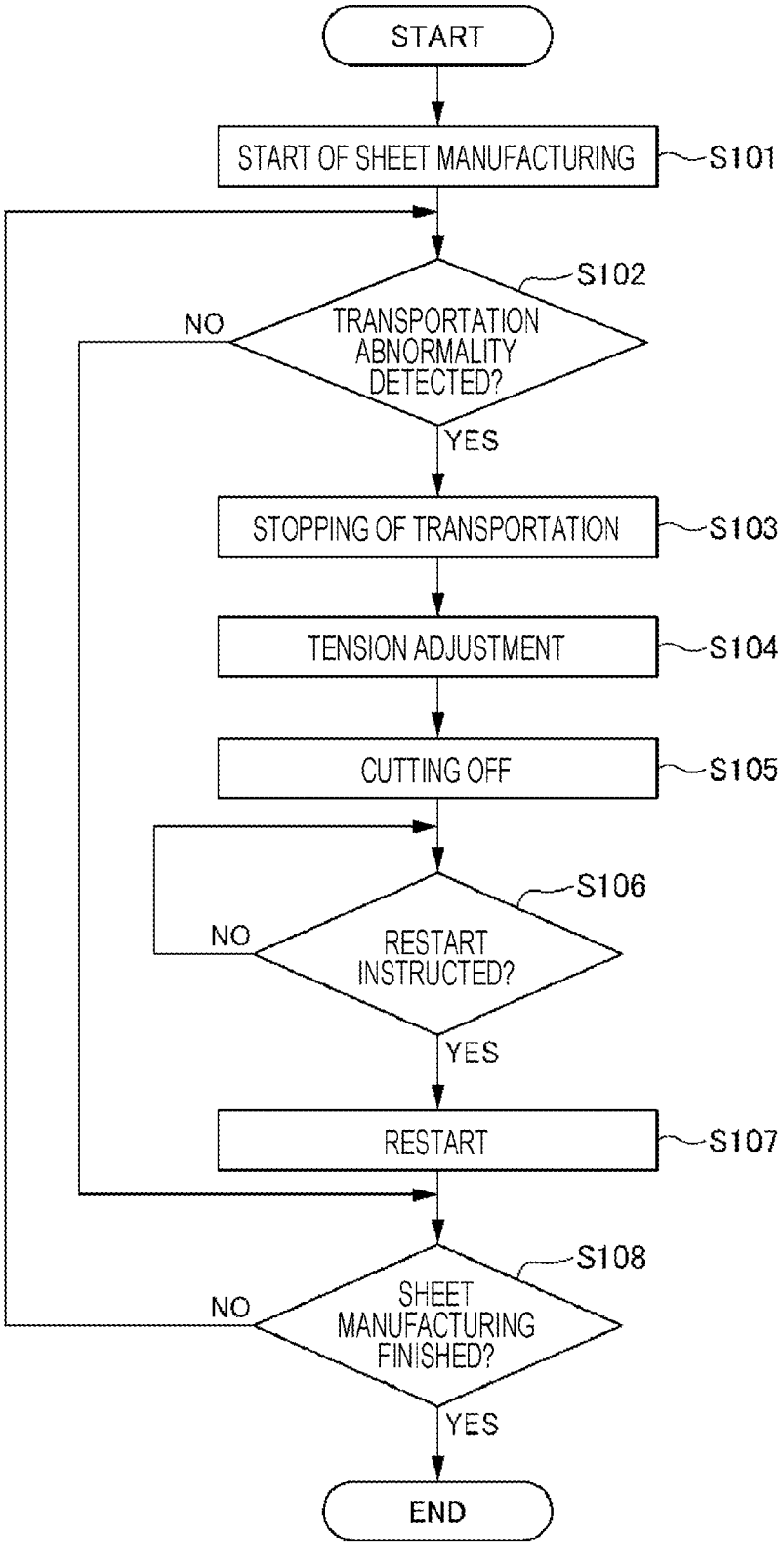
FIG. 8 is a flowchart for explaining control operation performed by a control unit illustrated in FIG. 3.

FIG. 1 is a schematic side view of the upstream half of a sheet manufacturing apparatus according to an embodiment of the present disclosure. FIG. 2 is a schematic side view of the downstream half of a sheet manufacturing apparatus according to an embodiment of the present disclosure. FIG. 3 is a block diagram of major components of the sheet manufacturing apparatus illustrated in FIGS. 1 and 2. Each of FIGS. 4 to 7 is an enlarged view, for explaining operation performed when transportation abnormality occurs, of a section enclosed by a broken-line frame illustrated in FIG. 2. FIG. 8 is a flowchart for explaining control operation performed by a control unit illustrated in FIG. 3.

In the description below, in order to facilitate an explanation, three axes orthogonal to one another will be referred to as the x axis, the y axis, and the z axis as shown in FIGS. 1, 2, and 4 to 7. The x-y plane including the x axis and the y axis is horizontal. The z axis is vertical. The direction indicated by the head of an arrow on each axis is denoted as "+". The opposite direction is denoted as "−". An upper position in FIGS. 1, 2, 4 to 7 will be referred to as "above/over" or "upper", and a lower position will be referred to as "below/under" or "lower". The left side in FIGS. 1, 2, 4 to 7 will be referred to as "upstream", and the right side thereof will be referred to as "downstream".

As illustrated in FIGS. 1 and 2, a sheet manufacturing apparatus 100 includes a raw material supplying unit 11, a coarse crushing unit 12, a defibrating unit 13, a screening unit 14, a first web forming unit 15, fragmenting unit 16, a mixing unit 17, a disentangling unit 18, a second web forming unit 19, a sheet forming unit 20, a separate sheet shaping unit 21, a stock unit 22, a transportation unit 25, a tension adjustment unit 26, a collection unit 27, a control unit 28, a cutting-off unit 29, and an abnormality detection unit 30. Components that constitute the sheet manufacturing apparatus 100 are electrically coupled to the control unit 28 illustrated in FIG. 3. The operation of them is controlled by the control unit 28.

As illustrated in FIG. 1, the sheet manufacturing apparatus 100 further includes humidifying units 251, 252, 253, 254, 255, and 256. In addition, the sheet manufacturing apparatus 100 includes blowers 173, 261, 262, and 263.

In the sheet manufacturing apparatus 100, a raw material supplying process, a coarse crushing process, a defibrating process, a screening process, a first web forming process, a fragmenting process, a mixing process, a disentangling process, a second web forming process, a sheet forming process, and a cutting process are performed in this order.

The structure of each unit will now be explained.

As illustrated in FIG. 1, the raw material supplying unit 11 is a section that performs a raw material supplying process of supplying a raw material M1 to the coarse crushing unit 12. An example of the raw material M1 is a sheet-like material containing fibers, including cellulose fibers. The cellulose fiber may be any fibrous body containing cellulose as a main compound, and may contain hemicellulose or lignin in addition to cellulose. The form of the raw material M1 is not limited, for example, may be woven fabric or non-woven fabric. The raw material M1 may be, for example, recycled paper reproduced by defibrating used paper or synthetic YUPO paper (registered trademark), or may be non-recycled paper. In the present embodiment, the raw material M1 is waste paper that has been used or is no longer needed.

The coarse crushing unit 12 is a section that performs a coarse crushing process of coarsely crushing the raw material M1 supplied from the raw material supplying unit 11 in air such as atmospheric conditions. The coarse crushing unit 12 includes a pair of coarse crushing blades 121 and a chute 122.

By rotating in respective directions that are the opposite of each other, the pair of coarse crushing blades 121 is able to coarsely crush, that is, shred, the raw material M1 therebetween into coarse crushed pieces M2. It will be advantageous if the coarse crushed piece M2 has a shape and size suitable for defibration by the defibrating unit 13. For example, preferably, the length of a side of the small piece may be 100 mm or less. More preferably, the length of a side of the small piece may be, for example, 10 mm or more and 70 mm or less.

The chute 122 is provided under the pair of coarse crushing blades 121 and has a shape like, for example, a funnel. The chute 122 is able to receive the coarse crushed pieces M2 coarsely crushed by, and falling from, the coarse crushing blades 121.

The humidifying unit 251 is provided next to the pair of coarse crushing blades 121 over the chute 122. The humidifying unit 251 humidifies the coarse crushed pieces M2 in the chute 122. The humidifying unit 251 includes a non-illustrated filter that contains moisture. The humidifying unit 251 is a vaporizing humidifier, in particular, a warm-air-vaporization-type humidifier, configured to supply humidified air with increased humidity to the coarse crushed pieces M2 by passing air through the filter. Supplying humidified air to the coarse crushed pieces M2 makes it possible to prevent the static cling of the coarse crushed pieces M2 to the chute 122 and the like.

The chute 122 is connected to the defibrating unit 13 via a pipe 241. The coarse crushed pieces M2 gathered into the chute 122 are sent to the defibrating unit 13 through the pipe 241.

The defibrating unit 13 is a section that performs a defibrating process of defibrating the coarse crushed pieces M2 in air, which means dry defibration. It is possible to produce a defibrated material M3 from the coarse crushed pieces M2 through the defibrating process performed by the defibrating unit 13. The term "defibration" means the disentanglement of the coarse crushed pieces M2 made of plural entangled fibers into individual fibers. The result of the disentanglement is the defibrated material M3. The defibrated material M3 has a string shape or a ribbon shape. The defibrated material M3 may be in a state of so-called "lumps", in which defibrated fibers are intertwined with one another in an agglomerated manner.

The defibrating unit 13 is, for example, in the present embodiment, an impeller mill that includes a rotor that rotates at a high speed and a liner that is located at the outer circumference of the rotor, though not illustrated. The coarse crushed pieces M2 that have flowed into the defibrating unit 13 go into the gap between the rotor and the liner and are defibrated.

By rotation of the rotor, the defibrating unit 13 is able to produce the flow of air, that is, airflow, from the coarse crushing unit 12 toward the screening unit 14. The airflow enables the defibrating unit 13 to suck the coarse crushed pieces M2 from the pipe 241. After the defibration, it is possible to send the defibrated material M3 to the screening unit 14 through a pipe 242.

A blower 261 is provided between the ends of the pipe 242. The blower 261 is an airflow generator that generates airflow toward the screening unit 14. This promotes the delivery of the defibrated material M3 to the screening unit 14.

The screening unit 14 is a section that performs a screening process of screening the defibrated material M3 according to the lengths of fibers. In the screening unit 14, the defibrated material M3 is sorted into a first screened material M4-1 and a second screened material M4-2, which is larger than the first screened material M4-1. The first screened material M4-1 has a size suitable for the subsequent manufacture of a sheet S. The average length may be preferably 1 μm or more and 30 μm or less. The second screened material M4-2 contains, for example, insufficiently defibrated fibers, excessive agglomeration of defibrated fibers, and the like.

The screening unit 14 has a drum portion 141 and a housing portion 142, which houses the drum portion 141.

The drum portion 141 is a sieve that has a cylindrical net structure and rotates around its central axis. The defibrated material M3 flows into the drum portion 141. By rotation of the drum portion 141, the defibrated material M3 that is smaller than the mesh of the net is sorted as the first screened material M4-1, and the defibrated material M3 that is larger than the mesh of the net is sorted as the second screened material M4-2.

The first screened material M4-1 falls from the drum portion 141.

On the other hand, the second screened material M4-2 is sent to a pipe 243 connected to the drum portion 141. The pipe 243 is connected to the pipe 241 at its end that is the opposite of an end connected to the drum portion 141, that is, at the upstream end. The second screened material M4-2 that has flowed through the pipe 243 merges with the coarse crushed pieces M2 inside the pipe 241 and flows together with the coarse crushed pieces M2 into the defibrating unit 13. By this means, the second screened material M4-2 is returned to the defibrating unit 13 and is subjected to defibration again together with the coarse crushed pieces M2.

The first screened material M4-1 discharged from the drum portion 141 falls while being dispersed in air, and travels toward the first web forming unit 15, which is located under the drum portion 141. The first web forming unit 15 is a section that performs a first web forming process of forming a first web M5 from the first screened material M4-1. The first web forming unit 15 includes a mesh belt 151, three stretching rollers 152, and a suction unit 153.

The mesh belt 151 is an endless belt, and the first screened material M4-1 is deposited thereon. The mesh belt 151 is stretched around the three stretching rollers 152. The first screened material M4-1 on the mesh belt 151 is transported downstream by the rotation of the stretching rollers 152.

The first screened material M4-1 has a size larger than the mesh of the mesh belt 151. Therefore, the first screened material M4-1 falling down is unable to pass through the mesh belt 151 and thus becomes deposited on the mesh belt 151. The first screened material M4-1 is transported downstream together with the mesh belt 151 while depositing on the mesh belt 151. Therefore, the first web M5 that has a layer shape is formed.

There is a possibility that the first screened material M4-1 contains foreign particles, for example, dust, or particles like dust. For example, coarse crushing or defibration sometimes produces dust or the like. Dust or the like is collected into the collection unit 27 described later.

The suction unit 153 is a suction mechanism that sucks air from below the mesh belt 151. By this means, it is possible to suck dust or the like that has passed through the mesh belt 151, together with air.

The suction unit 153 is connected to the collection unit 27 via a pipe 244. The dust or the like sucked by the suction unit 153 is collected into the collection unit 27.

A pipe 245 is connected to the collection unit 27. A blower 262 is provided between the ends of the pipe 245. By the operation of the blower 262, a suction force can be generated in the suction unit 153. This promotes the forming of the first web M5 on the mesh belt 151. Therefore, the first web M5 is substantially free from dust or the like. Dust or the like flows through the pipe 244 to reach the collection unit 27 by the operation of the blower 262.

The housing portion 142 is connected to the humidifying unit 252. The humidifying unit 252 is a vaporizing humidifier, similarly to the humidifying unit 251. Therefore, humidified air is supplied into the housing portion 142. The humidified air humidifies the first screened material M4-1. This prevents the static cling of the first screened material M4-1 to the inner wall of the housing portion 142.

The humidifying unit 255 is provided downstream of the screening unit 14. The humidifying unit 255 is an ultrasonic humidifier that sprays water. Ultrasonic spraying supplies moisture to the first web M5, thereby adjusting the moisture content of the first web M5. The moisture adjustment prevents the static cling of the first web M5 to the mesh belt 151. Therefore, the first web M5 comes off easily from the mesh belt 151 at a position where the mesh belt 151 is turned back by the stretching roller 152.

The fragmenting unit 16 is provided downstream of the humidifying unit 255. The fragmenting unit 16 is a section that performs a fragmenting process, in which the first web M5 that has come off from the mesh belt 151 is fragmented. The fragmenting unit 16 includes a propeller 161 that is rotatably supported and a housing portion 162 that houses the propeller 161. By rotating the propeller 161, it is possible to fragment the first web M5. The first web M5 is broken into fragments M6. The fragments M6 drop inside the housing portion 162.

The housing portion 162 is connected to the humidifying unit 253. The humidifying unit 253 is a vaporizing humidifier, similarly to the humidifying unit 251. Therefore, humidified air is supplied into the housing portion 162. The humidified air prevents the static cling of the fragments M6 to the propeller 161 or the inner wall of the housing portion 162.

The mixing unit 17 is provided downstream of the fragmenting unit 16. The mixing unit 17 is a section that performs a mixing process of mixing the fragments M6 with a binder P1. The mixing unit 17 includes a binder supplying portion 171, a pipe 172, and a blower 173.

The pipe 172, through which a mixture M7 of the fragments M6 and the binder P1 flows, connects the housing portion 162 of the fragmenting unit 16 and a housing portion 182 of the disentangling unit 18.

The binder supplying portion 171 is connected between the ends of the pipe 172. The binder supplying portion 171 includes a screw feeder 174. By rotation of the screw feeder 174, it is possible to supply the binder P1 that is in the form of powder or particles into the pipe 172. The binder P1 supplied into the pipe 172 is mixed with the fragments M6 to turn into the mixture M7.

The binder P1 bonds fibers together in subsequent processes. For example, a thermoplastic resin, a curable resin, starch, dextrin, glycogen, amylose, hyaluronic acid, arrowroot, konjac, dogtooth violet starch, etherified starch, esterified starch, natural gum glue (etherified tamarind gum, etherified locust bean gum, etherified guar gum, acacia arabica gum), fiber induction glue (etherified carboxymethyl cellulose, hydroxyethyl cellulose), seaweed (sodium alginate, agar), animal protein (collagen, gelatin, hydrolyzed collagen, sericin), etc. can be used. A thermoplastic resin, among them, can be preferably used. Examples of the thermoplastic resin include an AS resin, an ABS resin, polyethylene, polypropylene, polyolefin such as an ethylene-vinyl acetate copolymer (EVA), modified polyolefin, an acrylic resin such as polymethyl methacrylate, polyvinyl chloride, polystyrene, polyester such as polyethylene terephthalate and polybutylene terephthalate, polyamide such as nylon 6, nylon 46, nylon 66, nylon 610, nylon 612, nylon 11, nylon 12, nylon 6-12, and nylon 6-66, polyphenylene ether, polyacetal, polyether, polyphenylene oxide, polyetheretherketone, polycarbonate, polyphenylene sulfide, thermoplastic polyimide, polyetherimide, a liquid crystal polymer such as aromatic polyester, various thermoplastic elastomers such as a styrene-based thermoplastic elastomer, a polyolefin-based thermoplastic elastomer, a polyvinyl chloride-based thermoplastic elastomer, a polyurethane-based thermoplastic elastomer, a polyester-based thermoplastic elastomer, a polyamide-based thermoplastic elastomer, a polybutadiene-based thermoplastic elastomer, a trans polyisoprene-based thermoplastic elastomer, a fluoro rubber-based thermoplastic elastomer, and a chlorinated polyethylene-based thermoplastic elastomer, and the like. Any one selected from among those enumerated above, or a combination of two or more, may be used. Preferably, for example, polyester or a composition containing polyester can be used as the thermoplastic resin.

A colorant for coloring fibers, an aggregation inhibitor for inhibiting aggregation of fibers or aggregation of the binder P1, a flame retardant for making fibers difficult to burn, a paper strengthening agent for enhancing the strength of a sheet S, and the like, for example, may be included in addition to the binder P1 supplied from the binder supplying portion 171. Alternatively, a composite of the binder P1 containing any of them prepared in advance may be supplied from the binder supplying portion 171.

The blower 173 is provided downstream of the binder supplying portion 171 between the ends of the pipe 172. The fragments M6 and the binder P1 are mixed with each other by the action of the rotating portion such as blades of the blower 173. The blower 173 is able to generate airflow toward the disentangling unit 18. The airflow stirs the fragments M6 and the binder P1 inside the pipe 172. This makes it possible for the mixture M7 to flow into the disentangling unit 18 in a state in which the fragments M6 and the binder P1 are uniformly dispersed. The fragments M6 in the mixture M7 are disentangled in the process of flowing through the pipe 172, thereby turning into a finer fibrous form.

The disentangling unit 18 is a section that performs a disentangling process of disentangling fibers intertwined with one another in the mixture M7. The disentangling unit 18 has a drum portion 181 and a housing portion 182, which houses the drum portion 181.

The drum portion 181 is a sieve that has a cylindrical net structure and rotates around its central axis. The mixture M7 flows into the drum portion 181. When the drum portion 181 rotates, fibers, etc. that are smaller than the mesh of the net, among those contained in the mixture M7, are able to pass through the drum portion 181. In this process, the mixture M7 is disentangled.

The housing portion 182 is connected to the humidifying unit 254. The humidifying unit 254 is a vaporizing humidifier, similarly to the humidifying unit 251. Therefore, humidified air is supplied into the housing portion 182. The humidified air humidifies the inside of the housing portion 182. This prevents the static cling of the mixture M7 to the inner wall of the housing portion 182.

The mixture M7 disentangled in the drum portion 181 falls while being dispersed in air and travels toward the second web forming unit 19, which is located under the drum portion 181. The second web forming unit 19 is a section that performs a second web forming process of forming a second web M8 from the mixture M7. The second web forming unit 19 includes a mesh belt 191, stretching rollers 192, and a suction unit 193.

The mesh belt 191 is an endless belt, and the mixture M7 becomes deposited thereon. The mesh belt 191 is stretched around the four stretching rollers 192. The mixture M7 on the mesh belt 191 is transported downstream by the rotation of the stretching rollers 192.

The size of most of the mixture M7 on the mesh belt 191 is larger than the mesh of the mesh belt 191. Therefore, most of the mixture M7 is unable to pass through the mesh belt 191 and thus becomes deposited on the mesh belt 191. The mixture M7 is transported downstream together with the mesh belt 191 while depositing on the mesh belt 191. Therefore, the second web M8 that has a layer shape is formed.

The suction unit 193 is a suction mechanism that sucks air from below the mesh belt 191. Therefore, it is possible to suck the mixture M7 onto the mesh belt 191, and the deposition of the mixture M7 on the mesh belt 191 is promoted.

A pipe 246 is connected to the suction unit 193. A blower 263 is provided between the ends of the pipe 246. By the operation of the blower 263, a suction force can be generated in the suction unit 193.

The humidifying unit 256 is provided downstream of the disentangling unit 18. The humidifying unit 256 is an ultrasonic humidifier, similarly to the humidifying unit 255. Ultrasonic spraying supplies moisture to the second web M8, thereby adjusting the moisture content of the second web M8. The moisture adjustment prevents the static cling of the second web M8 to the mesh belt 191. Therefore, the second web M8 comes off easily from the mesh belt 191 at a position where the mesh belt 191 is turned back by the stretching roller 192.

The total moisture content added to the humidifying units 251 to 256 may be, for example, 0.5 parts by mass or more and 20 parts by mass or less with respect to 100 parts by mass of the material before humidification.

As illustrated in FIG. 2, the sheet forming unit 20 is provided downstream of the second web forming unit 19. The sheet forming unit 20 is a section that performs a sheet forming process of forming a continuous sheet S0 from the second web M8. The sheet forming unit 20 includes a pressing portion 201 and a heating portion 202.

The pressing portion 201 includes a pair of pressing rollers 203 and is able to press the second web M8 between the pressing rollers 203 without substantial heating. This increases the density of the second web M8. For example, the degree of substantial non-heating may be a degree that does not cause the melting of the binder P1. The second web M8 with increased density is transported to the heating portion 202. One of the pair of pressing rollers 203 is a master roller that is driven by the operation of a motor that is not illustrated, and the other is a slave roller.

The heating portion 202 includes a pair of heating rollers 204. It is possible to apply pressure while heating the second web M8 between the heating rollers 204. The heating and pressing causes the melting of the binder P1 in the second web M8. The molten binder P1 bonds the fibers together. As a result, a single continuous sheet S0 is formed. Then, the continuous sheet S0 is transported toward the separate sheet shaping unit 21. One of the pair of heating rollers 204 is a master roller that is driven by the operation of a motor that is not illustrated, and the other is a slave roller.

The pressing portion 201 and the heating portion 202 described above constitute a group of shaping rollers that process the shape of the web that includes the material containing fibers. The heating portion 202 may be omitted. The pressing rollers 203 of the pressing portion 201 may have a heating function.

The separate sheet shaping unit 21 is provided downstream of the sheet forming unit 20. The separate sheet shaping unit 21 is a section that performs a cutting process of cutting the continuous sheet S0 into the shape of the sheet S, which is an example of a separate sheet. The separate sheet shaping unit 21 includes a first cutter 211 and a second cutter 212. The second cutter 212 is provided downstream of the first cutter 211.

The first cutter 211 cuts the continuous sheet S0 in a direction that intersects with the transport direction of the continuous sheet S0, in particular, a direction that is orthogonal thereto. The first cutter 211 includes a pair of rollers 211A and blades 211B. These rollers 211A constituting the pair are provided at a distance from each other in the thickness direction of the sheet S that is being transported, namely, in the z-axis direction. The blade 211B protrudes from the circumferential surface of each of the pair of rollers 211A. The blade 211B is provided in such a way as to extend in the shaft direction of each of the pair of rollers 211A.

As illustrated in FIG. 3, the first cutter 211 is electrically coupled to the control unit 28. Its operation is controlled by the control unit 28. The first cutter 211 rotates in a direction indicated by each arrow thereof in FIG. 2. During the rotation, the blades 211B of the first cutter 211 come into contact with each other. Due to this blade contact, the continuous sheet S0 passing therebetween is cut. It is possible to adjust the length of the sheet S in the x-axis direction by adjusting the rotation speed of each of the pair of rollers of the first cutter 211.

The second cutter 212 cuts the sheet S in a direction parallel to the transport direction of the sheet S downstream of the first cutter 211. The second cutter 212 is comprised of four disc-shaped rotary blades 212A and 212B. The rotary blades 212A and the rotary blades 212B are provided opposite to each other such that the sheet S that is being transported is interposed therebetween, that is, with a transportation path 238 traversing therebetween. By the contact of the rotary blades 212A and the rotary blades 212B, it is possible to cut the sheet S that is being transported.

The rotary blades 212A and the rotary blades 212B each configured as a lateral pair in the width direction of the sheet S, that is, in the y-axis direction, are disposed. The purpose of cutting in this process is to remove unnecessary edge portions at both ends of the sheet S, that is, its +y directional end and −y directional end, to adjust the width of the sheet S properly. The cut and removed portion is called "waste edge".

In the second cutter 212, the distance between one and the other of the rotary blades 212A spaced from each other in the y-axis direction, and the distance between one and the other of the rotary blades 212B spaced from each other in the y-axis direction, are adjustable. It is possible to adjust the length of the sheet S in the y-axis direction by adjusting this distance.

A sheet S having a desired shape and size can be obtained by cutting with the first cutter 211 and the second cutter 212 described above. The sheet S is further transported downstream to the stock unit 22. Sheets S, including the sheet S, are stacked in the stock unit 22.

An ejection mechanism 23 has a function of transporting the sheet S having been cut into a separate shape to the stock unit 22. The ejection mechanism 23 includes post-cutting rollers 232, intermediate rollers 233, first ejection rollers 234, and second ejection rollers 235. The intermediate rollers 233, the first ejection rollers 234, and the second ejection rollers 235 are arranged in this order from the upstream in the transport direction of the sheet S, that is, from the −x side.

Each of the post-cutting rollers 232, the intermediate rollers 233, the first ejection rollers 234, and the second ejection rollers 235 are disposed as a roller pair, with the transportation path 238 traversing between the two rollers of each pair.

The post-cutting rollers 232 are disposed as a pair of rollers between the first cutter 211 and the second cutter 212, with the transportation path 238 traversing through a z-directional gap between the two rollers of the pair. The post-cutting rollers 232 contribute to transportation within a segment from the cutting of the continuous sheet S0 by the first cutter 211 till handover to the intermediate rollers 233. With the sheet S nipped between the post-cutting rollers 232, each of the post-cutting rollers 232 rotates in a direction indicated by an arrow in FIG. 2. By this rotation, it is possible to transport the sheet S after the cutting process in the +x direction.

One of the pair of post-cutting rollers 232 is a master roller that is driven by the operation of a motor that is not illustrated, and the other is a slave roller. As illustrated in FIG. 3, the motor-driven one of the pair of post-cutting rollers 232 is electrically coupled to the control unit 28. Its operation is controlled by the control unit 28.

The intermediate rollers 233 are disposed as a pair of rollers downstream of the second cutter 212, that is, on the +x side with respect to the second cutter 212, with the transportation path 238 traversing through a z-directional gap between the two rollers of the pair. The intermediate rollers 233 contribute to, especially, transportation of the sheet S after cutting off waste edges. With the sheet S nipped between the intermediate rollers 233, each of the intermediate rollers 233 rotates in a direction indicated by an arrow in FIG. 2. By this rotation, it is possible to transport, in the +x direction, the sheet S after cutting off waste edges.

One of the pair of intermediate rollers 233 is a master roller that is driven by the operation of a motor that is not illustrated, and the other is a slave roller. As illustrated in FIG. 3, the motor-driven one of the pair of intermediate rollers 233 is electrically coupled to the control unit 28. Its operation is controlled by the control unit 28.

The first ejection rollers 234 are disposed as a pair of rollers downstream of the intermediate rollers 233, that is, on the +x side with respect to the intermediate rollers 233, with the transportation path 238 traversing through a z-directional gap between the two rollers of the pair. The first ejection rollers 234 contribute to, especially, transportation of the sheet S toward the stock unit 22. With the sheet S nipped between the first ejection rollers 234, each of the first ejection rollers 234 rotates in a direction indicated by an arrow in FIG. 2. By this rotation, it is possible to transport the sheet S in the +x direction.

One of the pair of first ejection rollers 234 is a master roller that is driven by the operation of a motor that is not illustrated, and the other is a slave roller. As illustrated in FIG. 3, the motor-driven one of the pair of first ejection rollers 234 is electrically coupled to the control unit 28. Its operation is controlled by the control unit 28.

The second ejection rollers 235 are disposed as a pair of rollers downstream of the first ejection rollers 234, that is, on the +x side with respect to the first ejection rollers 234, with the transportation path 238 traversing through a z-directional gap between the two rollers of the pair. The second ejection rollers 235 contribute to, especially, transportation of the sheet S to the stock unit 22. With the sheet S nipped between the second ejection rollers 235, each of the second ejection rollers 235 rotates in a direction indicated by an arrow in FIG. 2. By this rotation, it is possible to transport the sheet S to the stock unit 22.

One of the pair of second ejection rollers 235 is a master roller that is driven by the operation of a motor that is not illustrated, and the other is a slave roller. As illustrated in FIG. 3, the motor-driven one of the pair of second ejection rollers 235 is electrically coupled to the control unit 28. Its operation is controlled by the control unit 28.

The rotation speed of each of the post-cutting rollers 232, the intermediate rollers 233, the first ejection rollers 234, and the second ejection rollers 235 described above is adjusted into an appropriate speed by the control unit 28.

The transportation unit 25 is provided between the heating rollers 204 and the separate sheet shaping unit 21. The transportation unit 25 transports the continuous sheet S0 formed by the sheet forming unit 20 to the separate sheet shaping unit 21. In the present embodiment, the transportation unit 25 is comprised of a pair of transportation rollers 251A. However, the scope of the present disclosure is not limited to this example. For example, the transportation unit 25 may be configured as an endless belt that performs sheet transportation by rotating.

The transportation rollers 251A constituting the pair are disposed such that the transportation path 238 traverses through a z-directional gap therebetween. With the sheet S nipped between the transportation rollers 251A, each of the transportation rollers 251A rotates in a direction indicated by an arrow in FIG. 2. By this rotation, it is possible to transport the continuous sheet S0 to the separate sheet shaping unit 21.

One of the pair of transportation rollers 251A is a master roller that is driven by the operation of a motor that is not illustrated, and the other is a slave roller. As illustrated in FIG. 3, the motor-driven one of the pair of transportation rollers 251A is electrically coupled to the control unit 28. Its operation is controlled by the control unit 28.

The tension adjustment unit 26 has a function of adjusting a tension applied to the continuous sheet S0. The tension adjustment unit 26 is provided between the cutting-off unit 29 and the transportation rollers 251A above the upper surface of the sheet S that is being transported, that is, on the +z side. The tension adjustment unit 26 may be provided below the lower surface of the sheet S that is being transported, that is, on the −z side.

In the present embodiment, the tension adjustment unit 26 includes a roller 261A, a movement mechanism 262A such as a motor or a solenoid, and a tension detector 263A. The operation of the movement mechanism 262A brings the roller 261A closer to and away from the continuous sheet S0 that is moving. The tension is high in a state in which the roller 261 is pressed against the continuous sheet S0. The tension of the continuous sheet S0 is loosened in a state in which the roller 261 is retracted away from the position of being pressed against the continuous sheet S0. As illustrated in FIG. 3, the movement mechanism 262A is electrically coupled to the control unit 28. Its operation is controlled by the control unit 28.

In the present embodiment, the tension detector 263A is a torque sensor coupled to the roller 261A. The tension detector 263A is electrically coupled to the control unit 28. Information regarding a torque value detected by the tension detector 263A is transmitted to the control unit 28. Based on the Information regarding the torque value, the control unit 28 estimates the tension.

However, the scope of the present disclosure is not limited to this configuration. For example, the tension detector 263A may be in contact with the continuous sheet S0 and measure the tension directly.

As explained above, the sheet manufacturing apparatus 100 includes the tension adjustment unit 26 configured to adjust the tension of the continuous sheet S0 between the pressing portion 201 and the transportation unit 25. With this configuration, it is possible to reduce the occurrence of transportation abnormality such as jamming by adjusting the tension of the continuous sheet S0. Moreover, when a part of the continuous sheet S0 needs to be cut off due to the occurrence of transportation abnormality, this configuration makes it possible to cut off the part well by adjusting the tension of the continuous sheet S0.

The tension adjustment unit 26 lowers the tension of the continuous sheet S0 when a part of the continuous sheet S0 is to be cut off. This prevents the cutting of the continuous sheet S0 under extreme tension. Therefore, it is possible to obtain a cut end having a desired shape. Moreover, it is possible to prevent or reduce the movement of the end of the continuous sheet S0 to an unexpected position when the cutting is performed.

The tension adjustment unit 26 includes the roller 261A provided between the cutting-off unit 29 and the transportation unit 25 and capable of being brought closer to and away from the continuous sheet S0. This configuration makes it possible to adjust the tension of the continuous sheet S0 with further enhanced adjustment performance.

The cutting-off unit 29 is provided between the pressing rollers 203 and the transportation unit 25. The cutting-off unit 29 has a function of, when transportation abnormality has occurred on the continuous sheet S0 that is being transported, cutting off a part of the continuous sheet S0 where the transportation abnormality has occurred from the continuous sheet S0.

The cutting-off unit 29 includes a pair of rollers 291 and cutting blades 292. These rollers 291 constituting the pair are provided at a distance from each other in the thickness direction of the continuous sheet S0 that is being transported, namely, in the z-axis direction. The cutting blade 292 protrudes from the circumferential surface of each of the pair of rollers 291. The cutting blade 292 is provided in such a way as to extend in the shaft direction of each of the pair of rollers 291.

Each roller 291 rotates in a direction indicated by an arrow in FIG. 2. During the rotation, the cutting blades 292 come into contact with each other. Due to this blade contact, the continuous sheet S0 passing therebetween is cut. As illustrated in FIG. 3, the cutting-off unit 29 is electrically coupled to the control unit 28. Its operation is controlled by the control unit 28. That is, a non-illustrated motor coupled to each roller 291 is electrically coupled to the control unit 28. Its operation is controlled by the control unit 28.

The configuration of the cutting-off unit 29 is not limited to the above example. For example, the cutting-off unit 29 may be configured to cut off the part while moving in a direction intersecting with the transportation direction of the continuous sheet S0. The cutting-off unit 29 may be configured to cut off the part while moving in the z-axis direction. The cutting-off unit 29 may be configured to cut off the part by emitting an energy beam such as a laser beam.

The abnormality detection unit 30 has a function of detecting the occurrence of transportation abnormality on the continuous sheet S0 that is being transported. The abnormality detection unit 30 is provided between the tension adjustment unit 26 and the transportation unit 25. In the present embodiment, the abnormality detection unit 30 is an optical sensor. The abnormality detection unit 30 is provided at a position that is not on the transportation path 238 of the continuous sheet S0. In the illustrated configuration, the abnormality detection unit 30 is provided on the +z side with respect to the transportation path 238. Therefore, when the continuous sheet S0 goes off the transportation path 238, the abnormality detection unit 30 is able to detect it. The abnormality detection unit 30 is electrically coupled to the control unit 28. Information detected by the abnormality detection unit 30, that is, information on the occurrence of transportation abnormality, is transmitted to the control unit 28. The term "transportation abnormality" means a status that the continuous sheet S0 goes off the supposed course of the transportation path 238. Specifically, the term "transportation abnormality" means jamming, distortion, tearing, and the like.

As described above, the sheet manufacturing apparatus 100 includes the abnormality detection unit 30 that is an example of a detection unit that detects the transportation abnormality of the continuous sheet S0. With this configuration, it is possible to detect the occurrence of transportation abnormality on the continuous sheet S0. The abnormality detection unit 30 may be omitted, and an operator may find transportation abnormality by a visual check. In this case, upon finding the transportation abnormality, the operator activates the cutting-off unit 29.

As illustrated in FIG. 3, the control unit 28 includes a CPU (Central Processing Unit) 281 and a storage unit 282. The CPU 281 is able to, for example, perform various kinds of determination and give various kinds of instructions.

Various programs such as, for example, a program for manufacturing sheets S are stored in the storage unit 282.

The control unit 28 may be built in the sheet manufacturing apparatus 100, or may be provided in an external device such as an external computer. The external device may, for example, communicate with the sheet manufacturing apparatus 100 via a cable or the like or wirelessly. The external device may be connected to the sheet manufacturing apparatus 100 via a network such as, for example, the Internet.

The CPU 281 and the storage unit 282 may be, for example, integrated into a single unitized component. The CPU 281 may be built in the sheet manufacturing apparatus 100, and the storage unit 282 may be provided in an external device such as an external computer. The storage unit 282 may be built in the sheet manufacturing apparatus 100, and the CPU 281 may be provided in an external device such as an external computer.

Figure 4:
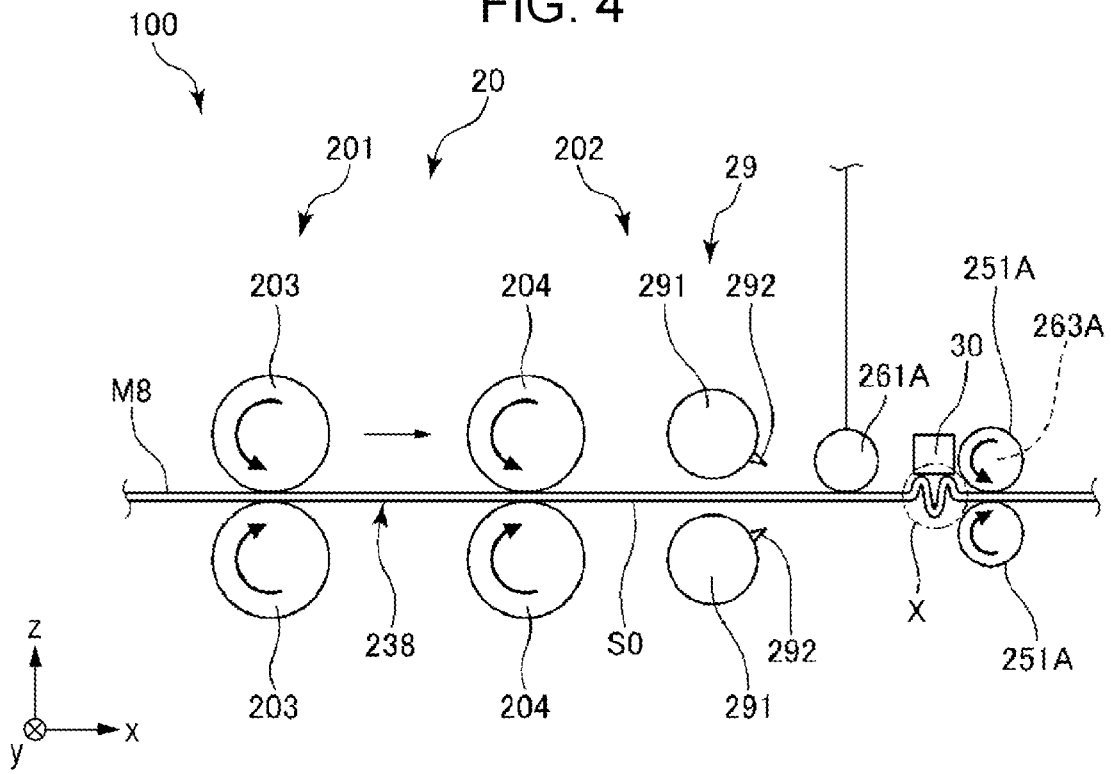
FIG. 4 is an enlarged view, for explaining operation performed when transportation abnormality occurs, of a section enclosed by a broken-line frame illustrated in FIG. 2.
Figure 5:
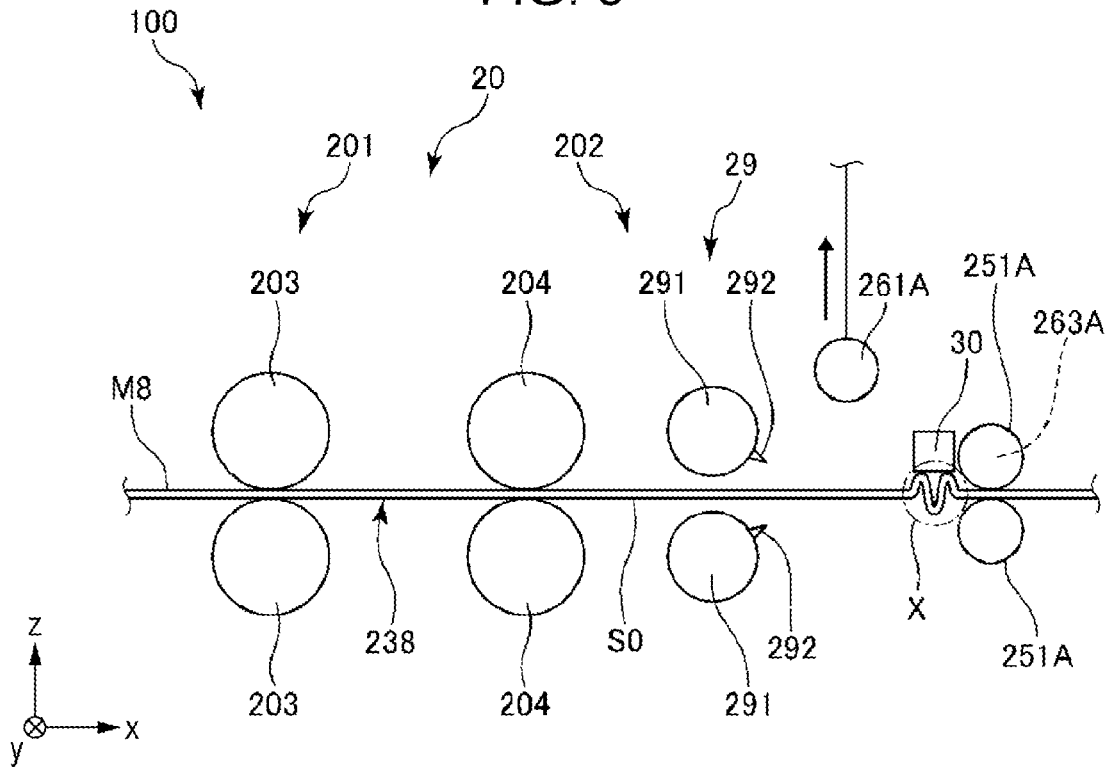
FIG. 5 is an enlarged view, for explaining operation performed when transportation abnormality occurs, of the section enclosed by the broken-line frame illustrated in FIG. 2.

In the sheet manufacturing apparatus 100 described above, when transportation abnormality occurs as illustrated in FIG. 4, the abnormality detection unit 30 detects it. Then, as illustrated in FIG. 5, the transportation of the continuous sheet S0 is stopped, and the tension adjustment unit 26 loosens the tension of the continuous sheet S0 into a tension value that is suitable for cutting off the part. Next, as illustrated in FIG. 6, the rollers 291 of the cutting-off unit 29 are rotated so as to cut the continuous sheet S0 by the cutting blades 292. Finally, as illustrated in FIG. 7, the part X cut off from the continuous sheet S0 is removed.

With this configuration, it is possible to cut off the part X where the transportation abnormality has occurred from the continuous sheet S0, and to remove the part X. In particular, the continuous sheet S0 has a continuous sheet form that is relatively long. In related art, if transportation abnormality occurs on such a long continuous sheet, the apparatus is temporarily stopped, and the location of the abnormality is identified. Then, in related art, after the identifying of the location of the abnormality, an operator cuts off the part where the abnormality has occurred, and removes the part cut off. In the present disclosure, the cutting-off unit 29 cuts off a part of the continuous sheet S0, including the part X where the transportation abnormality has occurred, specifically, cuts off the part from the position of cutting by the cutting-off unit 29 to the position of cutting by the first cutter 211. Therefore, it is possible to troubleshoot and clear the transportation abnormality just by removing the part cut off, which is easy.

The scope of the present disclosure is not limited to the above configuration, in which the operation of the cutting-off unit 29 is controlled by the control unit 28. For example, the operator may operate the cutting-off unit 29 manually.

As described above, the sheet manufacturing apparatus 100 includes: the pressing portion 201 that includes the pressing roller 203 that presses the second web M8, which is a material containing fibers and the binder P1, the binder P1 having a function of bonding the fibers together, to form the material into a shape of the continuous sheet S0; the separate sheet shaping unit 21 that cuts the continuous sheet S0 into a shape of the sheet S, which is an example of a separate sheet; the transportation unit 25 provided between the pressing roller 203 and the separate sheet shaping unit 21 and configured to transport the continuous sheet S0 formed by the pressing portion 201 to the separate sheet shaping unit 21; and the cutting-off unit 29 provided between the pressing roller 203 and the transportation unit 25, wherein, when transportation abnormality occurs on the continuous sheet S0 that is being transported, the cutting-off unit 29 cuts off, from the continuous sheet S0, a part X of the continuous sheet S0 where the transportation abnormality occurs. With this configuration, when transportation abnormality occurs, it is possible to cut off the part, of the continuous sheet S0, from the position of cutting by the cutting-off unit 29 to the position of cutting by the separate sheet shaping unit 21. Therefore, it is possible to troubleshoot and clear the transportation abnormality just by removing the part cut off, which is easy.

It is especially difficult to troubleshoot and clear the transportation abnormality by using related art if the transportation unit 25 includes the pair of transportation rollers 251A and, in addition, if the transportation abnormality is jamming that occurs on the pair of transportation rollers 251A. Therefore, the advantageous effect of the present disclosure is more conspicuous in this case.

The cutting-off unit 29 cuts off a part, of the continuous sheet S0, located downstream of the pressing roller 203 and upstream of the part X where the transportation abnormality occurs, in a direction intersecting with a transportation direction of the continuous sheet S0. Therefore, the sheet cut off includes the part X. This makes it possible to remove the part X where the transportation abnormality occurs, with enhanced removal reliability.

The cutting-off unit 29 has the cutting blade 292 extending in a direction intersecting with the transportation direction of the continuous sheet S0. This makes it possible to cut the continuous sheet S0 in the width direction easily and thus makes it possible to cut off the part speedily.

Next, with reference to the flowchart of FIG. 8, the control operation performed by the control unit 28 will now be explained.

First, in a step S101, manufacturing of sheets is started. That is, each component of the sheet manufacturing apparatus 100 is activated so as to start the manufacturing of sheets S.

Next, in a step S102, it is determined whether transportation abnormality is detected or not. The determination in this step is made based on the result of detection by the abnormality detection unit 30.

If it is determined in the step S102 that transportation abnormality has occurred, transportation is stopped in a step S103. That is, the operation of relevant components of the sheet manufacturing apparatus 100, in particular, the operation of the transportation unit 25, is stopped. When the transportation is stopped, preferably, a non-illustrated notification unit may output a notification to the effect that the transportation abnormality has occurred. If it is determined in the step S102 that no transportation abnormality has occurred, the process proceeds to a step S108.

Next, in a step S104, the tension of the continuous sheet S0 is adjusted. For example, as illustrated in FIG. 5, this step is executed by bringing the roller 261A of the tension adjustment unit 26 away from the continuous sheet S0.

Next, in a step S105, the cutting-off unit 29 is activated so as to cut off, from the continuous sheet S0, the part X of the continuous sheet S0 where the transportation abnormality has occurred. Then, the operator removes the sheet including the cut-off part X.

Next, in a step S106, it is determined whether an instruction for restarting sheet manufacturing is given or not. The determination in this step is made based on, for example, whether a non-illustrated restart button is pressed by the operator or not. If it is determined in the step S106 that an instruction for restarting sheet manufacturing is given, sheet manufacturing is restarted in a step S107. If it is determined in the step S106 that no instruction for restarting sheet manufacturing is given, the process waits until there is an input of a restart instruction.

Next, in a step S108, it is determined whether sheet manufacturing has finished or not. The determination in this step is made based on, for example, whether the number of sheets S that have been manufactured has reached a predetermined number of sheets or not. If it is determined in the step S108 that sheet manufacturing has finished, the running of the program is ended. If it is determined in the step S108 that sheet manufacturing has not finished yet, the process returns to the step S102, and the step S102 and the subsequent steps are executed in sequence.

As described above, the sheet manufacturing apparatus 100 includes the control unit 28 that controls the operation of the cutting-off unit 29 based on the result of detection by the abnormality detection unit 30, which is an example of a detection unit. With this configuration, when transportation abnormality occurs, it is possible to cut off the part, of the continuous sheet S0, from the position of cutting by the cutting-off unit 29 to the position of cutting by the separate sheet shaping unit 21. Therefore, it is possible to remove the part X where the transportation abnormality has occurred just by removing this part, which is easy.

Although a sheet manufacturing apparatus according to the illustrated embodiment has been described above, the scope of the present disclosure is not limited to the foregoing examples. The units constituting the sheet manufacturing apparatus may be replaced with arbitrary alternatives that fulfill the same functions. Arbitrary components may be added.

What is claimed is:

1. A sheet manufacturing apparatus comprising:

a pressing unit that includes a pressing roller that presses a material containing fibers and a binder, the binder having a function of bonding the fibers together, to form the material into a shape of a continuous sheet;

a separate sheet shaping unit that cuts the continuous sheet into a shape of a separate sheet;

a transportation unit including a pair of transportation rollers or an endless belt, the transportation unit being provided between the pressing roller and the separate sheet shaping unit and configured to transport the continuous sheet formed by the pressing unit to the separate sheet shaping unit; and a cutter provided between the pressing roller and the transportation unit, when transportation abnormality occurs on the continuous sheet that is being transported, the cutter cutting off a part, of the continuous sheet, located downstream of the pressing roller and upstream of a part where the transportation abnormality occurs, in a direction intersecting with a transportation direction of the continuous sheet, the transportation abnormality being a status that the continuous sheet goes off a transportation path that is defined at least by the pressing roller and the transportation unit.

2. The sheet manufacturing apparatus according to claim 1, wherein the cutter has a cutting blade extending in the direction intersecting with the transportation direction of the continuous sheet.

3. The sheet manufacturing apparatus according to claim 1, further comprising:

a tension adjustment unit that includes a roller and adjusts a tension of the continuous sheet between the pressing unit and the transportation unit.

4. The sheet manufacturing apparatus according to claim 3, wherein the tension adjustment unit lowers the tension of the continuous sheet when the part of the continuous sheet is to be cut off.

5. The sheet manufacturing apparatus according to claim 4, wherein the roller of the tension adjustment unit is disposed between the cutter and the transportation unit and configured to be brought closer to and away from the continuous sheet.

6. The sheet manufacturing apparatus according to claim 1, further comprising:

a detection sensor that detects the transportation abnormality.

7. The sheet manufacturing apparatus according to claim 6, further comprising:

a control unit including a processor that controls operation of the cutter, based on a result of detection by the detection sensor.

8. The sheet manufacturing apparatus according to claim 1, wherein the transportation unit includes the pair of transportation rollers, and the transportation abnormality is jamming that occurs on the pair of transportation rollers.

* * * * *